United States Patent [19]

Kagawa et al.

[11] Patent Number: 4,670,684

[45] Date of Patent: Jun. 2, 1987

[54] SPARK PLUG

[75] Inventors: Junichi Kagawa; Takafumi Oshima, both of Aichi, Japan

[73] Assignee: NGK Spark Plug Co., Ltd., Aichi, Japan

[21] Appl. No.: 613,488

[22] Filed: May 24, 1984

[51] Int. Cl.[4] ..... H01T 13/20

[52] U.S. Cl. ..... 313/141; 313/142

[58] Field of Search ..... 313/141, 142, 136

[56] References Cited

U.S. PATENT DOCUMENTS

| | | | |
|---|---|---|---|
| 2,326,028 | 8/1943 | Griffiths | 313/141 |
| 2,391,456 | 12/1945 | Hensel | 313/141 |
| 4,488,081 | 12/1984 | Kondo et al. | 313/141 |

*Primary Examiner*—David K. Moore

*Attorney, Agent, or Firm*—Sughrue, Mion, Zinn, Macpeak & Seas

[57] ABSTRACT

A spark plug is disclosed having central and ground electrodes made of a nickel-base alloy and a chip made of a platinum-nickel alloy having good bonding properties to the nickel-base alloy joined to the spark discharge surface of at least one of the central and ground electrodes. In another embodiment, the chip has an intermediate layer made of the platinum-nickel alloy and a top surface layer made of platinum or a platinum-base alloy having a higher spark wear resistance than the platinum-nickel alloy. Since the chip has good bonding properties to the nickel-base alloy, peeling of the chip from the central or ground electrode does not occur, and thus the spark plug has a high durability. If a chip having intermediate and top surface layers is used, since the top surface layer exhibits a higher spark wear resistance, the resulting spark plug is of higher durability.

3 Claims, 5 Drawing Figures

| | | |
|---|---|---|
| Pt |  | CRACKS DEVELOP<br>LARGE GAP |
| Pt 10Ni |  | RATHER LARGE GAP |
| Pt 20Ni |  | SMALL GAP<br>GOOD |
| Pt 40Ni |  | SMALL GAP<br>GOOD |
| Pt 60Ni |  | SMALL GAP<br>GOOD |
| Pt 20Ir |  | LARGE GAP |

SPARK PLUG

BACKGROUND OF THE INVENTION

The present invention relates to an improved spark plug, and more particularly to a spark plug which has an improved high temperature durability compared with conventional spark plugs.

It is known that the durability of a spark plug can be improved by joining a thin piece (chip electrode) of platinum (Pt) or a platinum-base alloy such as a platinum-iridium (Pt-Ir) alloy and a platinum-rodium (Pt-Rh) alloy by electric welding to the spark discharge surface of the central and ground electrodes, which are made of nickel-base alloys. A spark plug provided with such a platinum-base chip electrode, however, has several disadvantages. For example, (1) the chip electrode can peel from the central or ground electrode if the spark plug is heated to a temperature above 1,000° C., (2) cracks can develop due to the growth of crystal grains in the chip electrode due to heating, and (3) when the spark plug is used for long periods of time, the spark wear increases.

In order to overcome the above-described problems, experiments have been carried out by the inventors in which various types of platinum-base alloys were joined by welding to nickel-base alloys (e.g., a nickel-silicon-chromium-manganese (Ni-Si-Cr-Mn) alloy and a nickel-chromium-iron (Ni-Cr-Fe) alloy) and were subjected to a heat cycle test to evaluate their bonding properties. Based on the results of these tests, the following have been observed:

(1) Platinum-nickel alloys are superior in peeling or exfoliating resistance to platinum and platinum-base alloys such as a platinum-iridium alloy and a platinum-rhodium alloy.

(2) For the platinum-nickel alloys, as the nickel content is increased, the bonding properties are improved. However, if the nickel content is increased beyond 23% by weight, the advantageous characteristics of platinum (i.e., spark wear resistance) tend to be lost.

(3) As the amount of nickel added to platinum is increased, the spark wear resistance is reduced. For example, a 80% platinum—20% iridium alloy is superior in spark wear resistance to a 80% platinum—20% nickel alloy.

(4) Development of cracks in the platinum chip electrode during heat cycling is ascribable to the growth of crystal grains. Addition of nickel has proved to be effective in preventing the growth of such grains.

In summary, it has been found that a platinum-nickel alloy exhibits good bonding properties to nickel-base alloys, and, furthermore, that if the nickel content of the platinum-nickel alloy is within a specific range, the resulting platinum-nickel alloy is also superior in spark wear resistance.

SUMMARY OF THE INVENTION

An object of the invention is thus to provide a spark plug which has an improved high temperature durability.

Another object of the invention is to provide a chip electrode which has superior bonding properties to central and ground electrodes made of nickel-base alloys and furthermore is superior in spark wear resistance.

It has been found that these objects can be attained by employing a platinum-nickel alloy in the fabrication of a chip electrode for a spark plug. Accordingly, the present invention provides a spark plug which comprises cental and ground electrodes wherein a chip electrode of a platinum-nickel alloy is joined to the spark discharge surface of at least one of the central and ground electrodes.

DESCRIPTION OF THE PREFERRED EMBODIMENTS

The present invention will now be described in detail with reference to the accompanying drawings.

Figure 1:
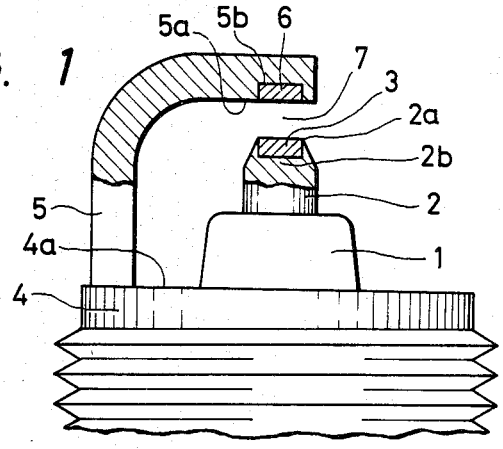
FIG. 1 is a schematic cross-sectional view of an ignition part of a spark plug according to a first preferred embodiment of a spark plug of the present invention.

Referring to FIG. 1, there is shown a schematic cross-sectional view of an ignition part of a spark plug according to a first embodiment of the present invention. This spark plug includes a porcelain insulator 1 made of, e.g., alumina, a central electrode 2 made of a nickel-base alloy (e.g., a nickel-silicon-chromium-manganese alloy and a nickel-chromium-iron alloy (Inconel)) projecting from the insulator 1 and secured thereto by knwon procedures, and a chip 3 made of a platinum-nickel alloy and joined by electric welding to the spark discharge surface 2*a* of the central electrode 2. This platinum-nickel alloy is composed of 5 to 23% by weight of nickel, the balance being platinum. The chip 3 is, for example, a disc having a thickness of 0.1 to 1.0 mm embedded in a cavity 2*b* formed in the top portion of the central electrode 2 and joined thereto. The porcelain insulator 1 is coaxially moumnted on a main metal body 4. The leg portion of the insulator 1 projects from a ring-like end surface 4*a* of the main metal body 4. A ground electrode 5 is made of the same nickel-base alloy as used in the fabrication of the central electrode 2 and is rectangular in cross section. This ground electrode 5 is L shaped, and has one end joined to the ring-like end surface 4*a* of the main metal body 4 and the other end arranged to form a spark gap between it and the chip 3. A chip 6 is provided in a spark discharge surface 5*a* of the ground electrode 5 facing the central electode 2. This chip 6 is made of the same platinum-nickel alloy used in the fabrication of the chip 3 (i.e., composed of 5 to 23% by weight of nickel, the balance being platinum). For example, the chip 6 is embedded in a cavity 5*b* formed in the ground electrode 5 and joined thereto. The chips 3 and 6 can be arranged appropriately depending on the power source polarity and the characteristics of the engine in which the spark plug is to be employed.

Figure 2:
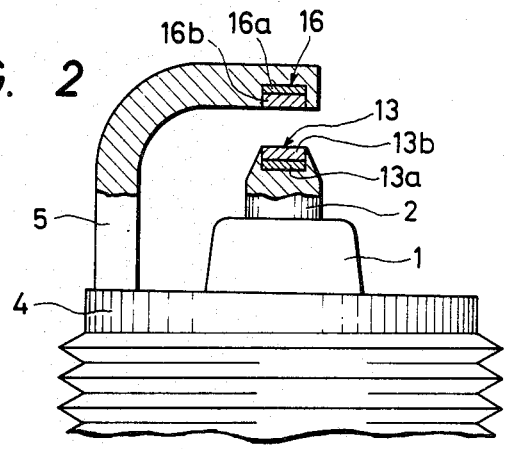
FIG. 2 is a schematic cross-sectional view of an ignition part of a spark plug according to another embodiment of the present invention.

A second embodiment of the present invention is shown in FIG. 2. Chips 13 and 16 are joined to a spark discharge surface 2*a* of a central electrode 2 and a spark discharge surface 5*a* of a ground electrode 5, respectively. The chip 13 is composed of an intermediate layer 13*a* and a top surface layer 13*b* provided on the intermediate layer 13*a*. The intermediate layer 13*a* is made of a platinum-nickel alloy containing 10 to 60% by weight of nickel, the balance being platinum. The top surface layer 13*b* is made of platinum or a platinum-base alloy having a high spark wear resistance, for instance, a platinum-iridium alloy (iridium: 10 to 30%), a platinum-rhodium alloy (rhodium: 10 to 40%), a platinum-rhodium-nickel alloy (10 to 40% rhodium, 2 to 10% nickel, the balance being platinum), and a platinum-iridium-nickel alloy (10 to 30% iridium, 2 to 10% nickel, the balance being platinum). The chip 16 is of the same structure as the chip 13. That is, the chip 16 is composed of an intermediate layer 16*a* and a top surface layer 16*b* provided on the intermediate layer 16*a*. The intermediate layer 16*a* is made of the same platinum-nickel alloy used in the fabrication of the intermediate layer 13*a*, and the top surface layer 16*b* is also made of the same platinum or platinum-base alloy as used in the fabrication of the top surface layer 13*b*. The chip 13 or 16 can be constructed in any suitable manner. For example, the platinum-nickel alloy and the platinum or platinum-base alloy having a high spark wear resistance can be shaped in advance into a cladding plate and the cladding plate then joined by welding, or platinum-nickel alloy and platinum or platinum-base alloy plates can be fabricated and joined separately by welding, or platinum-nickel alloy and platinum or platinum-base alloy plates can be joined together and then secured to the electrodes.

Figure 3:
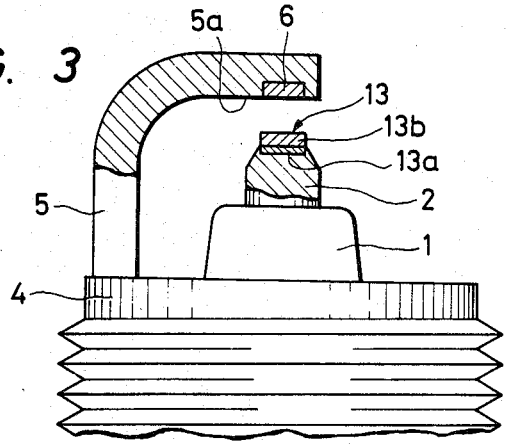
FIG. 3 is a schematic cross-sectional view of an ignition part of a spark plug according to still another embodiment of the present invention.

A third embodiment of the present invention is shown in FIG. 3. A spark discharge surface 2*a* of a central electrode 2 is, as in the case of the embodiment of FIG. 2, provided with a chip 13 which is prepared by joining together an intermediate layer 13*a* of a platinum-nickel alloy containing 10 to 60% by weight nickel, the balance being platinum, and a top surface layer 13*b* made of platinum or a platinum-base alloy having high spark wear resistance as described above. To a spark discharge surface 5*a* of a ground electrode 5 which faces the chip 13 is, as in the case with the embodiment of FIG. 1, joined a chip 6 made of a platinum-nickel alloy containing 5 to 23% by weight nickel, the balance being platinum, which possesses, as well as good bonding properties, good wear resistance. This embodiment is preferred in cases where a negative potential is applied to the central electrode so that it tends to wear more quickly than the ground electrode. On the other hand, in cases where the wear of the central electrode is negligible but the ground electrode tends to wear more quickly, the opposite combination to that of FIG. 3 is preferred.

The present invention can be summarized as follows:

First Embodiment

In cases where it is desired to improve the peeling resistance of a chip while retaining its antioxidation properties and spark wear resistance (which are characteristic of platinum), or the spark wear resistance is negligible in view of the polarity of the power source and only the peeling resistance is of significance, a platinum-nickel alloy containing 5 to 23% by weight nickel, the balance being platinum, is used in the fabrication of the chip, thereby increasing the durability of the resulting spark plug.

Second Embodiment

In a case where the wear of a spark discharge surface is an especially significant problem, the spark discharge surface is made of platinum or a platinum-base alloy such as a platinum-iridium alloy and a platinum-rhodium alloy which possess a high spark wear resistance. That is, the surface portion of a chip is made of a metal of high spark wear resistance as described above, and it is then joined utilizing a platinum-nickel alloy layer having good bonding properties as an intermediate layer. In this case, since the spark wear resistance of the intermediate layer may be somewhat reduced, a platinum-nickel alloy containing 10 to 60% by weight nickel, the balance being platinum, can be used in the fabrication of the intermediate layer.

Third Embodiment

This embodiment is a combination of the first and second embodiments, and is suitable to employ where the wear resistance of either one of the central and ground electrodes should be increased to a relatively high level. In this case, the production costs can be reduced.

Although the present invention has been described above in connection with a sparking electrode of a spark plug, it is also applicable to a case where a nickel-base alloy material and a noble metal chip are used as joint materials to be used in an engine having a high-temperature heat cycle.

Figure 4:
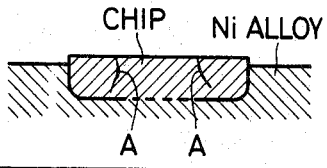
FIG. 4 shows the state in which a chip electrode has begun to peel in a heat cycle test.
Figure 4:
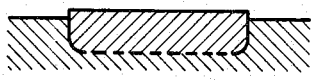
Figure 4:
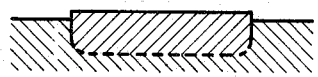
Figure 4:
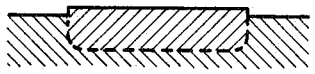
Figure 4:
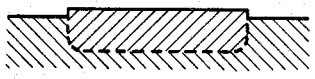
Figure 4:
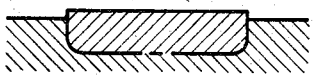

The characteristics of the platinum-nickel alloy of the present invention will hereinafter be explained in detail. FIG. 4 shows the results of a heat cycle test. This heat cycle test was conducted as follows:

Thin plates (thickness: 0.4 mm) of platinum-nickel alloys containing 10, 20, 40 and 60% by weight nickel, (i.e., Pt-10Ni, Pt-20Ni, Pt-40Ni and Pt-60Ni) were each placed in a cavity of a nickel-base alloy plate and joined by electric welding. In addition, a comparative specimen were produced in the same manner as above except that pure platinum and a platinum-iridium alloy containing 20% by weight iridium, the balance being platinum (i.e., Pt-20Ir), respectively, were used in place of the nickel-base alloy. These specimens were subjected to 3,000 heat cycles consisting of heating at 1,100° C. for one minute with a burner and cooling to 200° C. Then each specimen was examined. In FIG. 4, the solid lines indicate gaps formed by peeling of the thin plate from the nickel-base alloy plate, and the dotted lines indicate areas in which no gaps were formed.

In the comparative specimen produced using pure platinum, a gap was formed along most of the boundary between the thin plate and the nickel-base alloy plate, and furthermore cracks A developed in the thin plate. In the comparative specimen produced using Pt-20Ir, although no cracks developed, a gap was formed along almost the whole of the boundary. These results demonstrate that for both the comparative specimens the bonding properties between the thin plate and the nickel-base alloy plate are poor. On the other hand, in the specimens produced using the platinum-nickel alloy of the present invention, as the nickel content is increased, the gaps are reduced and the bonding properties improved. Even in the case of the specimen in which the nickel content was 10% by weight, almost no gaps were formed on the bottom of the cavity and satisfactory bonding properties were obtained. However, if the nickel content of the platinum-nickel alloy was below 5% by weight, sufficient and satisfactory bonding properties were not obtained. Moreover, if the nickel content was in excess of 60% by weight, although the bonding properties were improved, the anti-oxidation resistance was seriously reduced, and therefore, the resulting spark plug was unsuitable for practical use.

Figure 5:
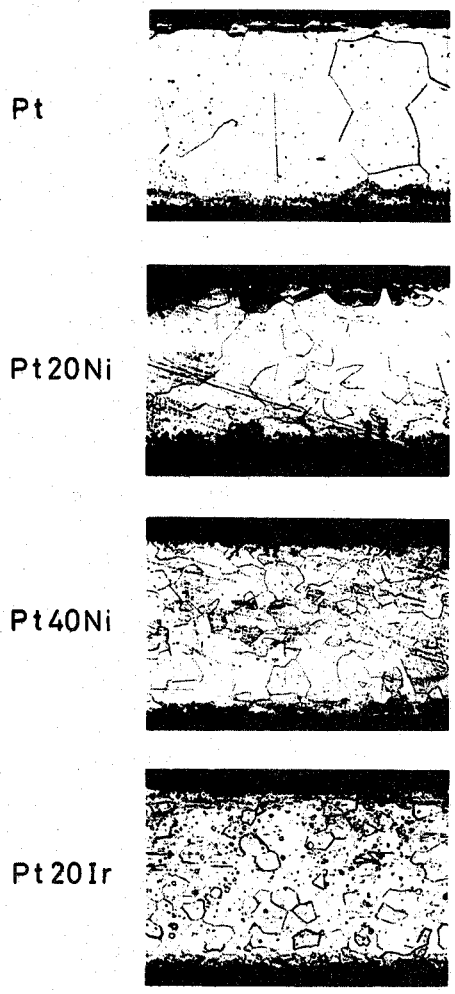
FIG. 5 shows a series of microscopic photographs illustrating metal structures in an anti-oxidation test.

Microscopic photographs (X100) shown in FIG. 5 illustrate the metal structure for test specimens of Pt-20Ni and Pt-40Ni of the present invention, a comparative test specimen of pure platinum and Pt-20Ir, which were all placed in a furnace and maintained at 1,100° C. for 10 hours. It can be seen that the addition of nickel to platinum reduces the growth of crystal grains, thereby preventing the development of cracks. In practice, however, it has been confirmed that the upper limit of the amount of nickel that can be added is 23% by weight in view of the spark wear due to spark discharge.

In the spark plug of the present invention, as described above, a chip of a platinum-nickel alloy exhibiting good bonding properties to a nickel-base alloy material is used and, therefore, peeling of the chip is prevented. That is, the spark plug of the present invention is of high durability. If the chip is required to have a high spark wear resistance, it is sufficient to set the amount of nickel added within the range of from 5 to 23% by weight. In a case that the spark wear resistance is required to be higher, the chip is fabricated so as to consist of a top surface layer of platinum or a platinum-base alloy of high spark wear resistance (e.g., a platinum-iridium alloy and a platinum-rhodium alloy) and an intermediate layer of the platinum-nickel alloy of the present invention. Thus, the resulting spark plug is free from the peeling of the chip and has a high durability.

We claim:

1. A spark plug comprising: central and ground electrodes made of a nickel-base alloy; a chip comprising a top surface layer of platinum or a platinum alloy and an intermediate layer of a platinum-nickel alloy containing 10 to 60% by weight nickel, the balance being platinum, joined to a spark discharge surface of one of said central and ground electrodes more strongly subject to spark wear than the other; and a chip of a platinum-nickel alloy containing 5 to 23% by weight nickel, the balance being platinum, joined to a spark discharge surface of the other electrode.

2. A spark plug comprising: central and ground electrodes made of a nickel-base alloy; and a chip joined to a spark discharge surface of at least one of said central and ground electrodes, said chip comprising an intermediate layer of a platinum-nickel alloy having good bonding properties to said nickel-base alloy and a top surface layer of platinum or a platinum-base alloy having a higher spark wear resistance than said platinum-nickel alloy and wherein said platinum-nickel alloy contains 10 to 60% by weight nickel, the balance being platinum.

3. The spark plug as claimed claim 2, wherein said platinum-nickel alloy is an alloy selected from the group consisting of a platinum-iridium alloy, a platinum-iridium-nickel alloy, a platinum-rhodium alloy, and a platinum-rhodium-nickel alloy.

* * * * *